US009993851B2

(12) United States Patent
Jones

(10) Patent No.: US 9,993,851 B2
(45) Date of Patent: Jun. 12, 2018

(54) ULTRASONIC CLEANING APPARATUS AND METHOD

(71) Applicant: ALPHASONICS (ULTRASONIC CLEANING SYSTEMS) LTD., Prescot (GB)

(72) Inventor: David Stanley Jones, Prescot (GB)

(73) Assignee: ALPHASONICS (ULTRASONIC CLEANING SYSTEMS) LTD., Prescot (GB)

( * ) Notice: Subject to any disclaimer, the term of this patent is extended or adjusted under 35 U.S.C. 154(b) by 55 days.

(21) Appl. No.: 15/023,092

(22) PCT Filed: Sep. 9, 2014

(86) PCT No.: PCT/GB2014/052725
§ 371 (c)(1),
(2) Date: Mar. 18, 2016

(87) PCT Pub. No.: WO2015/040365
PCT Pub. Date: Mar. 26, 2015

(65) Prior Publication Data

US 2016/0228927 A1 Aug. 11, 2016

(30) Foreign Application Priority Data

Sep. 20, 2013 (GB) ..... 1316716.8
May 13, 2014 (GB) ..... 1408428.9
Sep. 2, 2014 (GB) ..... 1415530.3

(51) Int. Cl.
*B08B 3/12* (2006.01)
*B08B 3/02* (2006.01)
(Continued)

(52) U.S. Cl.
CPC ..... *B08B 3/12* (2013.01); *B01F 3/04106* (2013.01); *B01F 3/04262* (2013.01); *B08B 3/02* (2013.01);
(Continued)

(58) Field of Classification Search
CPC ..... B08B 3/12; B08B 3/044; B01F 3/04106; A61L 2/025
See application file for complete search history.

(56) References Cited

U.S. PATENT DOCUMENTS 2,828,231 A 3/1958 Henry
4,409,999 A 10/1983 Pedziwiatr
(Continued)

FOREIGN PATENT DOCUMENTS

CN 102211098 A 10/2011
CN 202752272 U 2/2013
(Continued)

OTHER PUBLICATIONS

International Search Report carried out by the European Patent Office for PCT/GB2014/052725 dated Dec. 12, 2014.
(Continued)

*Primary Examiner* — Mikhail Kornakov
*Assistant Examiner* — Natasha N Campbell
(74) *Attorney, Agent, or Firm* — Shumaker, Loop & Kendrick, LLP

(57) ABSTRACT

An ultrasonic cleaning apparatus and method, the ultrasonic cleaning apparatus (10) comprising a tank (12) for in use receiving a cleaning liquid and for receiving an item to be cleaned in a cleaning region (16) thereof, a transducer (21) arranged, when driven, to direct ultrasonic pressure waves into cleaning liquid received in the tank (12) and a controller (30) arranged in use to drive the transducer (21), a gas introducer (40) arranged to in use provide a supply of gas
(Continued)

into cleaning liquid in the tank so that macroscopic bubbles of gas are produced wherein the gas introducer (40) provides a plurality of bubble sources distributed below the cleaning region of the tank. The apparatus further comprises an assembly arranged in use to enable movement of the item to be cleaned in the cleaning region.

12 Claims, 6 Drawing Sheets

(51) Int. Cl.

| | |
|---|---|
| ***B08B 3/04*** | (2006.01) |
| ***B08B 3/10*** | (2006.01) |
| ***B08B 5/02*** | (2006.01) |
| ***B01F 3/04*** | (2006.01) |

(52) U.S. Cl.
CPC ..... *B08B 3/045* (2013.01); *B08B 3/104* (2013.01); *B08B 5/02* (2013.01)

(56) References Cited

U.S. PATENT DOCUMENTS

| | | | | |
|---|---|---|---|---|
| 4,710,233 | A * | 12/1987 | Hohmann | A61L 2/035 134/1 |
| 4,727,734 | A | 3/1988 | Kanazawa et al. | |
| 4,733,679 | A * | 3/1988 | Dolcater | B44D 3/006 134/138 |
| 5,014,727 | A * | 5/1991 | Aigo | B01F 3/04241 134/102.2 |
| 5,487,599 | A | 1/1996 | Hannah | |
| 5,849,091 | A | 12/1998 | Skrovan et al. | |
| 2008/0308132 | A1 | 12/2008 | Tomita et al. | |
| 2009/0223536 | A1 | 9/2009 | Nomura et al. | |
| 2010/0224214 | A1 | 9/2010 | Kaneko et al. | |

FOREIGN PATENT DOCUMENTS

| | | | |
|---|---|---|---|
| CN | 103658101 | A | 3/2014 |
| GB | 2518477 | A | 3/2015 |

OTHER PUBLICATIONS

Combined Search and Examination Report Under Sections 17 & 18(3) of corresponding British Application No. GB1408428.9 dated Aug. 14, 2014; 2 pages.

European Office Action issued in relation to corresponding European Patent Application No. 14772413.2, dated Feb. 15, 2018, 4 pages.

* cited by examiner

ULTRASONIC CLEANING APPARATUS AND METHOD

FIELD

Example embodiments relate to ultrasonic cleaning apparatus and methods, in particular ultrasonic cleaning apparatus and methods in which macroscopic bubbles are provided in a cleaning tank and in which drying is effected.

BACKGROUND

Ultrasonic cleaning typically involves immersing an item to be cleaned in a tank of cleaning liquid, then directing ultrasonic pressure waves into the tank. The pressure waves produce micro-cavitation in the liquid, which has a cleaning effect at the surface of the item to be cleaned.

In ultrasonic cleaning of this nature it is important to make good use of the ultrasound to increase efficiency. Problems can arise in distributing the ultrasonic pressure waves so that they are effective across the whole surface of the item to be cleaned, as standing waves linked to tank geometry can lead to the ultrasound in some parts of the tank being ineffective, and in other parts of the tank being too aggressive so as to potentially cause damage to the surface being cleaned.

There is a particular problem in providing an effective clean without damaging the surface which is being cleaned when the dirt on the surface is not evenly distributed and/or is composed of different types of material. For example, in cleaning surgical instruments before sterilisation, there may be various types of biological material on the instruments, in different sized clumps. For this type of cleaning application effective removal of large pieces of dirt is essential to guarantee that the sterilization process can be performed effectively.

Another problem encountered when trying to providing an effective clean is to enable a tank form that can be used for many cleaning operations without itself entrapping, retaining or entraining dirt from the item or items that are cleaned. For example, dead volumes, interstices or passageways in the tank may collect dirt in a way that then reduces the effectiveness of subsequent cleaning operations. For example, in a process of cleaning surgical instruments before sterilisation, there may be various types of biological material on the instruments, in different sized clumps, that are removed by cleaning from the surface of the instruments. However, this material may be transferred to and retained in the tank by a rack, mount, support or holder for the surgical instruments, or other features within the tank. For this type of cleaning application, effective removal of dirt from surfaces of the tank is desirable to increase the effectiveness of that the cleaning process from one cleaning operation to the next.

There is also a problem in providing effective drying without dirtying the surface which has been cleaned. For example, in cleaning surgical instruments before sterilisation, there may be various types of material on the instruments in the cleaning liquid that remain on the instruments when they are removed from the tank of cleaning liquid. For this type of cleaning application, effective removal of cleaning liquid is useful to enable the sterilization process to be performed effectively.

Example embodiments of the present invention aim to address one or more problems associated with the prior art, for example those problems set out above.

SUMMARY OF THE INVENTION

In one example embodiment, the present invention provides an ultrasonic cleaning apparatus comprising:

a tank for in use receiving a cleaning liquid and for receiving an item to be cleaned in a cleaning region thereof;

a transducer arranged, when driven, to direct ultrasonic pressure waves into cleaning liquid received in the tank; and a controller arranged in use to drive the transducer;

a gas introducer arranged to in use provide a supply of gas into cleaning liquid in the tank so that macroscopic bubbles of gas are produced; characterised in that the gas introducer provides a plurality of bubble sources distributed below the cleaning region of the tank.

Suitably, the ultrasonic cleaning apparatus comprises a plurality of transducers, which are arranged, when driven, to direct ultrasonic pressure waves into cleaning liquid received in the tank.

Suitably, the tank comprises a plurality of wall portions, for example a bottom wall portion and one or more side walls portions.

Suitably, the bottom wall portion comprises no openings in, or passageways defined there-through. Suitably, the bottom wall portion comprises one opening in, or passageway defined there-through. Suitably, the opening or passageway is closeable, for example the opening or passageway comprises a plughole and plug. Suitably, the opening or passageway is a drain coupleable to further downstream drainage. Suitably, the plurality of wall portions are arranged with one another to form a tank comprising no openings in, or passageways defined through the wall portions. Suitably, the plurality of wall portions are arranged with one another to form a tank comprising no openings in, or passageways defined through the wall portions at a level below the operating surface of cleaning liquid contained in the tank in use. Suitably, the plurality of wall portions comprise one opening therein, or passageway defined there-through. Suitably, the opening or passageway is closeable, for example the opening or passageway comprises a plughole and plug. Suitably, the opening or passageway is a drain coupleable to further downstream drainage. Suitably, the tank comprises a single internal surface defined by the wall portions. Suitably, the single internal surface is generally concave, to in use receive the cleaning liquid. Suitably, the internal surface comprises only internal corners.

Suitably, the tank comprises one or more a planar wall portions. Suitably, the tank comprises a bottom wall portion to which a transducer is operatively fixed. Suitably, the tank comprises a side wall portion to which a transducer is operatively fixed. Suitably, the tank comprises a plurality of side wall portions, including two or more side wall portions arranged opposite one another. Suitably the tank comprises two side wall portions, for example two side wall portions that are arranged opposite one another, each of these wall portions having a transducer is operatively fixed there-to.

Suitably, the tank comprises a plurality of side wall portions arranged to define a cleaning region of the tank there-between, for example centrally there-to. Suitably, the tank comprises a plurality of side wall portions arranged to define a cleaning region between opposed side walls, for example between one, two or three pairs of opposed side walls. Suitably, the side wall regions are arranged to provide a symmetrical tank form. Suitably, the side wall regions are arranged to provide a polygonal form when viewed from above, for example a square cross section of constant or variable cross-sectional size over its depth, or equivalently a hexagonal, octagonal or other regular or irregular polygonal shape.

Suitably, the transducers are arranged in one or more groups. Suitably, the transducers are arranged into first and second groups, with a first group transducers of the first group arranged on a first wall portion of the tank, and a second ground of transducers arranged on a second wall portion of the tank.

Suitably, the plurality of transducers are arranged, such that in use when driven by the controller, to direct ultrasonic waves into an overlapping volume, that volume itself at least partially overlapping with the cleaning region.

Suitably, the controller is arranged in use to produce a drive signal for the transducers that is characterised by a centre frequency, a sweep range about the centre frequency and a sweep rate.

Suitably, the controller comprises a first frequency generator arranged to supply a first drive signal that comprises a primary centre frequency, sweep range and sweep rate, and a secondary centre frequency, sweep range and sweep rate.

Suitably, the controller is arranged in use to control the first and second frequency generator to switch between primary and secondary operation.

Suitably, the controller is arranged in use to control the first and second frequency generators to each switch between primary and secondary operation, with the sequential switching taking place to cause different combinations of primary and secondary operation for the first and second frequency generators to occur over time, for example in sequence. Suitably, a switch in primary or secondary operation occurs every one minute, two minutes, or every five minutes, for example.

Suitably, the controller is further arranged in use to vary the sweep rate over time, for example by switching between a first sweep rate and a second sweep rate.

Suitably, the gas introducer is arranged to in use provide a supply of air into the cleaning liquid in the tank. Suitably, the gas introducer is arranged to in use pump atmospheric air into the cleaning liquid in the tank. Suitably, the gas introducer is arranged to in use deliver compressed gas into the cleaning liquid in the tank. Suitably, the gas introducer comprises a supply of compressed gas, for example a supply of compressed air such as from a cylinder or other pressurised container.

Suitably, the gas introducer comprises a gas introduction conduit. Suitably, the gas introduction conduit is arranged to in use deliver gas to an outlet proximate to a bottom wall portion of the tank, or at least relatively closer to the bottom wall of the tank than to the top of the tank, or relatively closer to an operating surface of cleaning liquid contained in the tank in use.

Suitably, the gas introduction conduit comprises a rigid pipe.

Suitably, the gas introduction conduit is arranged to run across the tank, for example from one side wall portion to another, across the tank. Suitably, the gas introduction conduit comprises a perforated pipe, arranged to with bubble-forming outlets along its length.

Suitably, the bubble-forming outlets are provided across the cleaning region. Suitably, the gas introduction conduit is provided with a check valve, expansion chamber, raised portion, or other suitable back-flow protection so as to prevent loss of cleaning fluid in use when the gas is not operating to provide a supply of gas into the cleaning fluid. Suitably, the cleaning region is aligned with the gas introduction conduit, for example the cleaning region is arranged to lies directly above the gas introduction conduit. Suitably, the cleaning region is defined by space to receive, support or hold in place an item to be cleaned. Suitably, the cleaning region is provided with a rack, mount, support or holder for an item to be cleaned, for example a rack for surgical instruments, or a support for an anilox print roller.

Suitably the gas introduction conduit is arranged to enter the tank through its top, open, end and to extend down toward the bottom wall of the tank. Suitably the gas introduction conduit is arranged to enter the tank proximate to its top, open, end and to extend down toward the bottom wall of the tank at a position proximate, for example running down parallel to, a side wall portion of the tank.

Suitably, the gas introduction conduit is arranged to extend across the tank from a position proximate to a side wall in a direction inwardly from the side wall. Suitably, the gas introduction conduit is arranged to extend across the tank from a position proximate to the side wall toward a central regions of the tank, for example toward a central region of the tank below the cleaning region.

Suitably, the gas introduction conduit is arranged to lie against a wall portion of the tank, for at least part of the length of the gas introduction conduit. Suitably, the gas introduction conduit is formed integrally with, for example as a continuous extension of a wall portion of the tank, for at least a part of the length of the gas introduction conduit. Suitably, the gas introduction conduit is arranged to lie against a bottom wall portion of the tank, for at least part of the length of the gas introduction conduit. Suitably, the gas introduction conduit is formed integrally with, for example as a continuous extension of a bottom wall portion of the tank, for at least a part of the length of the gas introduction conduit.

Suitably, the gas introduction conduit comprises a bubble-forming outlet at its end region, for example only at its end region. Suitably, the gas forming conduit comprises a flexible member, for example a flexible tube provided to enable the point of delivery of gas to be moved, or to disrupt the bubble formation position as gas is delivered in use from the gas introduction conduit. In another embodiment the bubble-forming outlet comprises a diffuser, for example a sintered glass or other porous element provided at the outlet to in use divide gas issuing from the gas introduction conduit into relatively fine bubbles, for example in comparison to the cross sectional dimensions of the gas introduction conduit.

Suitably, the gas introducer comprises a plurality of gas introduction conduits, for example a plurality of gas introduction conduits as described above. Suitably, the gas introducer comprises a gas introduction conduits provided on a plurality of side wall portions. Suitably, the gas introducer comprises a gas introduction conduit for each side wall portion. Suitably, the gas introduction conduits are distributed around the periphery of the tank, for example with one or more gas introduction conduit per side wall portion, or on a subset of wall portions such as every other wall portion.

Suitably, the ultrasonic cleaning apparatus comprises a liquid introducer arranged to in use provide a supply of liquid into the cleaning liquid in the tank. Suitably, the liquid introducer is arranged in use to provide a jet of liquid that is delivered toward the cleaning region, for example into the cleaning region. Suitably, the liquid introducer is arranged in use to provide a plurality of jets of liquid that are delivered toward the cleaning region, for example into the cleaning region.

Suitably, the liquid introducer comprises a fluid introducer, arranged to in use provide a supply of fluid into the cleaning liquid in the tank. Suitably, the fluid comprises one or more of: liquid, gas. Suitably, the liquid comprises cleaning liquid. Suitably, the gas comprises air. Suitably, the liquid introducer is arranged in use to provide a jet of fluid that is delivered toward the cleaning region, for example into the cleaning region. Suitably, the liquid introducer is arranged in use to provide a plurality of jets of fluid that are delivered toward the cleaning region, for example into the cleaning region.

Suitably, the liquid introducer comprises a pump arranged to in use deliver cleaning liquid into the cleaning liquid in the tank. Suitably, the liquid introducer is arranged to in use circulate cleaning liquid from the tank into the cleaning liquid in the tank. Suitably, the liquid introducer is arranged to in use pump cleaning liquid from the drain into the cleaning liquid in the tank. Suitably, the liquid introducer comprises a filter. Suitably, the liquid introducer comprises a controller by which the rate of supply of liquid may be changed. Suitably, the liquid introducer comprises a controller by which the rate of flow from the jets of liquid may be changed.

Suitably, the liquid introducer comprises a pump arranged to in use deliver into the cleaning liquid in the tank one or more of: cleaning liquid, gas. Suitably, the liquid introducer comprises a controller by which the rate of supply of fluid may be changed. Suitably, the liquid introducer comprises a controller by which the rate of flow from the jets of fluid may be changed. Suitably, the liquid introducer comprises a controller by which the rate of supply of liquid may be changed. Suitably, the liquid introducer comprises a controller by which the rate of supply of gas may be changed.

Suitably, the liquid introducer comprises a liquid introduction conduit. Suitably, the liquid introduction conduit is arranged to in use deliver liquid to an outlet at a depth below the operating surface of cleaning liquid contained in the tank in use.

Suitably, the liquid introduction conduit comprises a fluid introduction conduit. Suitably, the liquid introduction conduit is arranged to in use deliver fluid to an outlet at a depth below the operating surface of cleaning liquid contained in the tank in use.

Suitably, the liquid introduction conduit comprises a rigid pipe. Suitably, the liquid introduction conduit comprises a non-rigid pipe.

Suitably, the liquid introduction conduit is provided with a check valve, expansion chamber, raised portion, or other suitable back-flow protection so as to prevent loss of cleaning fluid in use when the liquid introduction is not operating to provide a supply of liquid into the cleaning fluid.

Suitably, the liquid introduction conduit is arranged to enter the tank through its top, open, end and to extend down toward the bottom wall of the tank. Suitably the liquid introduction conduit is arranged to enter the tank proximate to its top, open, end and to extend down toward the bottom wall of the tank at a position proximate, for example running down, alongside or parallel to, a side wall portion of the tank.

Suitably, the liquid introduction conduit is arranged to extend across the tank from a position proximate to a side wall in a direction inwardly from the side wall. Suitably, the liquid introduction conduit is arranged to extend across the tank from a position proximate to the side wall toward a central regions of the tank, for example toward the cleaning region.

Suitably, the liquid introduction conduit is arranged to lie against a wall portion of the tank, for at least part of the length of the liquid introduction conduit. Suitably, the liquid introduction conduit is formed integrally with, for example as a continuous extension of a wall portion of the tank, for at least a part of the length of the liquid introduction conduit.

Suitably, the liquid introduction conduit comprises a jet-forming outlet at its end region, for example only at its end region. Suitably, the liquid introduction conduit comprises a plurality of jet-forming outlets at its end region, for example only at its end region.

Suitably, the jet-forming outlet is arranged to in use deliver liquid towards a region at or above the bubble-forming outlet. Suitably, the jet-forming outlet is arranged to in use deliver liquid towards the bubbles. Suitably, the jet-forming outlet is arranged to in use deliver liquid to disrupt bubbles provided from the gas introducer.

Suitably, the jet-forming outlet is arranged to in use deliver fluid towards a region at or above the bubble-forming outlet. Suitably, the jet-forming outlet is arranged to in use deliver fluid towards the bubbles. Suitably, the jet-forming outlet is arranged to in use deliver fluid to agitate bubbles provided from the gas introducer.

Suitably, the jet-forming outlet is arranged to in use deliver liquid towards the cleaning region. Suitably, the jet-forming outlet is arranged to in use deliver liquid towards the bubbles.

Suitably, the jet-forming outlet is arranged to in use deliver fluid towards the cleaning region. Suitably, the jet-forming outlet is arranged to in use deliver fluid comprising cleaning liquid and gas towards the bubbles.

Suitably, the liquid introducer comprises a plurality of liquid introduction conduits, for example a plurality of liquid introduction conduits as described above, for example two or more liquid introduction conduits as described above. Suitably, the liquid introducer comprises a plurality of liquid introduction conduits provided at a plurality of depths below the operating surface of cleaning liquid contained in the tank in use. Suitably, the liquid introducer comprises a plurality of liquid introduction conduits provided at a plurality of depths below the operating surface of cleaning liquid contained in the tank in use such that the depths are aligned with the cleaning region, for example aligned with the item to be cleaned, for example aligned with a rack for surgical instruments or a support for an anilox print roller. Suitably, the liquid introducer comprises a plurality of liquid introduction conduits provided on a plurality of side wall portions. Suitably, the liquid introducer comprises a liquid introduction conduit for each side wall portion. Suitably, the liquid introduction conduits are distributed around the periphery of the tank, for example with one or more cleaning liquid introduction conduit per side wall portion, or on a subset of wall portions such as every other wall portion.

Suitably, the ultrasonic cleaning apparatus comprises a drying gas introducer arranged to in use provide a supply of gas into the tank so that drying gas flow is produced. Suitably, the drying gas introducer is arranged to provide a plurality of gas flows distributed in the cleaning region of the tank, such as when the tank is drained of cleaning fluid and is to be dried.

Suitably, the drying gas introducer is arranged to in use provide a supply of gas into the tank. Suitably, the drying gas introducer is arranged to in use provide a supply of drying gas into the tank. Suitably, the drying gas introducer is arranged to in use provide a supply of air into the tank. Suitably, the drying gas introducer comprises a fan. Suitably, the drying gas introducer comprises a controller by which the rate of supply of gas may be changed. Suitably, the drying gas introducer comprises a fan controller. Suitably, the drying gas introducer comprises a filter.

Suitably, the drying gas introducer comprises a tank lid. Suitably, the tank lid is a removeable tank lid. Suitably, the tank lid comprises a fan. Suitably, the tank lid comprises a controller by which the rate of supply of drying gas may be changed. Suitably, the tank lid comprises a fan controller. Suitably, the tank lid comprises a drying gas inlet, for example a coupling to a gas supply, or one or more air vents.

Suitably, the drying gas introducer comprises a drying gas introduction conduit. Suitably, the drying gas introduction conduit is arranged to in use deliver gas to an outlet proximate to a bottom wall portion of the tank, or at least relatively closer to the bottom wall of the tank than to the top of the tank. Suitably, the drying gas introduction conduit is arranged to in use deliver gas to an outlet proximate to a bottom wall portion of the tank, or at least relatively closer to the bottom wall of the tank than to the top of the tank.

Suitably, the drying gas introduction conduit comprises a rigid pipe. Suitably, the drying gas introduction conduit comprises a non-rigid pipe.

Suitably, the drying gas introduction conduit is arranged to run across the tank, for example from one side wall portion to another, across the tank. Suitably, the drying gas introduction conduit comprises a perforated pipe, arranged with drying gas outlets along its length. Suitably, the drying gas outlets are provided across the cleaning region. Suitably, the gas introduction conduit is provided with a check valve, expansion chamber, raised portion, or other suitable back-flow protection so as to prevent loss of cleaning fluid in use when the gas is not operating to provide a supply of gas into the cleaning fluid. Suitably, the cleaning region is aligned with the drying gas introduction conduit, for example the cleaning region is arranged to be directly above the drying gas introduction conduit.

Suitably the drying gas introduction conduit is arranged to enter the tank through its top, open, end and to extend down toward the bottom wall of the tank. Suitably the drying gas introduction conduit is arranged to enter the tank proximate to its top, open, end and to extend down toward the bottom wall of the tank at a position proximate, for example running down, alongside or parallel to, a side wall portion of the tank.

Suitably, the drying gas introduction conduit is arranged to extend across the tank from a position proximate to a side wall in a direction inwardly from the side wall. Suitably, the drying gas introduction conduit is arranged to extend across the tank from a position proximate to the side wall toward a central regions of the tank, for example toward the cleaning region.

Suitably, the drying gas introduction conduit is arranged to lie against a wall portion of the tank, for at least part of the length of the drying gas introduction conduit. Suitably, the drying gas introduction conduit is formed integrally with, for example as a continuous extension of a wall portion of the tank, for at least a part of the length of the drying gas introduction conduit.

Suitably, the drying gas introducer comprises a plurality of drying gas introduction conduits, for example a plurality of drying gas introduction conduits as described above, for example two or more drying gas introduction conduits as described above. Suitably, the drying gas introducer comprises a plurality of drying gas introduction conduits provided on a plurality of side wall portions. Suitably, the drying gas introducer comprises a drying gas introduction conduit for each side wall portion. Suitably, the drying gas introduction conduits are arranged around the periphery of the tank, for example with one or more drying gas introduction conduits per side wall portion, or on a subset of wall portions such as every other wall portion or in an internal corner defined by two wall portions.

Suitably, the ultrasonic cleaning apparatus comprises an assembly arranged to in use enable movement of the item to be cleaned in the cleaning region. Suitably, the ultrasonic cleaning apparatus comprises an assembly arranged to in use provide movement of the item to be cleaned in the cleaning region. Suitably, the assembly is arranged to receive the item to be cleaned. Suitably, the assembly is provided without any mechanical drive means connected thereto, for example without any mechanical drive means connected thereto within the tank. Suitably, the assembly is provided for actuation from within the tank, for example from wholly within the tank. Suitably, the assembly is provided such that when the apparatus is in use performing a cleaning operation on the item to be cleaned no moving parts project from the surface of cleaning liquid provided in the tank. Suitably, the assembly is removable from the tank.

Suitably, the assembly comprises a rack arranged to receive the item to be cleaned. Suitably, the assembly comprises a plurality of racks arranged to receive the item to be cleaned, for example two, three or more racks, for example a stack of racks.

Suitably, the assembly comprises a rotor. Suitably, the rotor comprises a blade. Suitably, the rotor comprises a plurality of blades, for example two, three or more blades. Suitably, the blade is arranged to extend outwardly from the rotor. Suitably, the blade is arranged to extend generally radially from the rotor. Suitably, the blades in the plurality of blades are arranged about the rotor. Suitably, the rotor comprises a drum. Suitably, the blade is arranged to extend from a drum, for example outwardly from the drum. Suitably, the blade of the plurality of blades are arranged about the drum, for example spaced apart around an exterior surface thereof. Suitably, the assembly comprises a shaft. Suitably, the shaft is arranged to project substantially vertically in the tank. Suitably, the shaft is arranged on a wall of the tank. Suitably, the shaft is arranged on a bottom wall of the tank. Suitably, the rotor is arranged in use to rotate about the shaft. Suitably, the rotor is arranged in use to rotate in a generally horizontal plane about the shaft. Suitably, the rotor is arranged to rest on the shaft, or a bearing provided between the rotor and the shaft. Suitably, the rotor is removable from the shaft by lifting therefrom. Suitably, the rotor is removable from the shaft in a tool free manner, for example by resting on and by abutting the shaft to form the sole connection therebetween when in use. Suitably, the rotor is removable from the shaft in a tool free manner, for example by resting on and by abutting a bearing component between the rotor and the shaft to form the sole connection therebetween when in use.

Suitably, the assembly is arranged in use to be rotatable about a substantially vertical axis. Suitably, the assembly is arranged to be rotatable about the shaft. Suitably, the assembly is arranged to be in use rotatable in a substantially horizontal plane. Suitably, the assembly is arranged to in use rotate about a substantially vertical axis. Suitably, the assembly is arranged to in use rotate about the shaft. Suitably, the assembly is arranged to in use rotate in a substantially horizontal plane.

Suitably, the blade is arranged proximate the bottom wall of the tank. Suitably, the blade is arranged proximate a side wall of the tank. Suitably, the blade is arranged proximal the operating surface of cleaning liquid contained in the tank in use. Suitably, a plurality of blades is arranged proximate one or more of: the bottom wall of the tank, a side wall of the tank, the operating surface of cleaning liquid contained in the tank in use. Suitably, the rotor is arranged proximate the bottom wall of the tank.

Suitably, more than one blade in the plurality of blades comprises the features ascribed to the blade. Suitably, each blade effective in the assembly to provide the functionality of the assembly in use comprises the features ascribed to the blade. Suitably, each blade in the plurality of blades comprises the features ascribed to the blade.

Suitably, the apparatus comprises a conduit arranged to in use deliver bubbles towards the assembly to urge the assembly to move, for example said conduit comprising a gas introduction conduit as described above. Suitably, the apparatus comprises a conduit arranged to in use deliver bubbles towards the assembly to urge the assembly to move in response to the bubbles impinging thereon. Suitably, the apparatus comprises a conduit arranged to in use deliver bubbles towards the assembly to urge the assembly to move in response to the bubbles impinging thereon, without any other contact or mechanical drive provided. Suitably, the conduit is arranged to in use deliver bubbles towards one or more blades of the assembly. Suitably, the apparatus comprises a plurality of conduits. Suitably, the apparatus comprises a plurality of conduits arranged to in use deliver bubbles towards a blade, or toward a plurality of blades on a one-to-one, or one-to-many, or many-to-one basis. Suitably, the apparatus comprises a plurality of conduits is arranged to in use deliver bubbles towards a plurality of blades. Suitably, each conduit in the plurality of conduits comprises the features ascribed to the singular conduit.

Suitably, the assembly is arranged such that bubbles delivered from the conduit(s) urge the assembly to move, for example by urging the assembly to rotate. Suitably, the assembly is arranged such that in use bubbles delivered from the conduit(s) cause the assembly to move, for example by causing the assembly to rotate. Suitably, the assembly is arranged such that in use bubbles delivered from the conduit(s) cause the assembly to move, for example by causing the assembly to rotate while the apparatus is operating to perform a cleaning operation.

Suitably, the apparatus comprises a liquid conduit arranged to in use deliver liquid towards the assembly to urge the assembly to move. Suitably, the apparatus comprises a liquid conduit arranged to in use deliver liquid towards the assembly to urge the assembly to move in response to the liquid impinging thereon. Suitably, the apparatus comprises a liquid conduit arranged to in use deliver liquid towards the assembly to urge the assembly to move in response to the liquid impinging thereon, without any other contact or mechanical drive provided. Suitably, the liquid conduit is arranged to in use deliver liquid towards one or more blades of the assembly. Suitably, the apparatus comprises a plurality of liquid conduits arranged to in use deliver liquid towards a blade or towards a plurality of blades on a one-to-one, or one-to-many, or many-to-one basis. Suitably, the apparatus comprises a plurality of liquid conduits is arranged to in use deliver liquid towards a plurality of blades. Suitably, each liquid conduit in the plurality of liquid conduits comprises the features ascribed to the singular conduit.

Suitably, the assembly is arranged such that liquid delivered from the liquid conduit(s) urges the assembly to move, for example by urging the assembly to rotate.

Suitably, the conduit is operatively coupled to the gas introducer of the cleaning apparatus. Suitably, the liquid conduit is operatively coupled to the liquid introducer of the cleaning apparatus. Suitably, the gas introducer and/or liquid introducer is arranged to in use move the assembly while a cleaning operation is being performed.

In other example embodiments the present invention provides methods of ultrasonic cleaning, comprising use of the ultrasonic cleaning apparatus as set out above.

It is to be understood that disclosure herein of components, elements, units or the like being arranged to perform certain functions in use also provides disclosure of said components, elements, units or the like also actually in use performing said functions, and also disclosure of a method of operating said components, elements, units or the like in order to achieve the functional results, or other advantages discernible from the present documents.

BRIEF INTRODUCTION TO THE DRAWINGS

For a better understanding of the invention, and to show how embodiments of the same may be carried into effect, reference will now be made, by way of example, to the accompanying diagrammatic drawings in which.

DESCRIPTION OF EXAMPLE EMBODIMENTS

Figure 2:
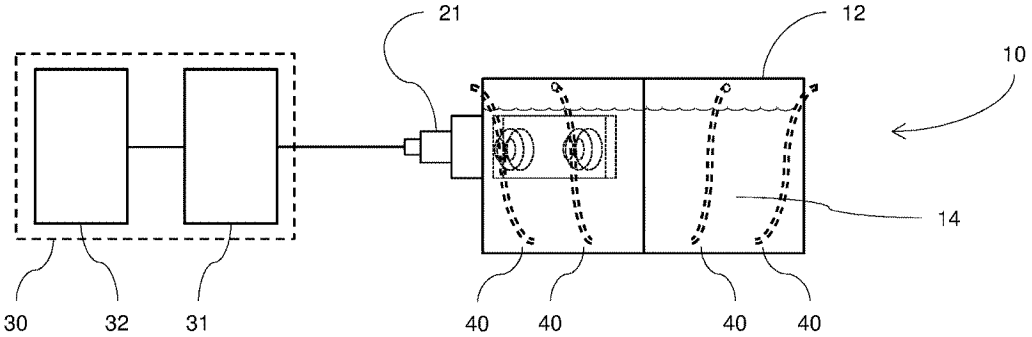
FIG. 2 shows a schematic side view of the ultrasonic cleaning apparatus of FIG. 1.
Figure 1:
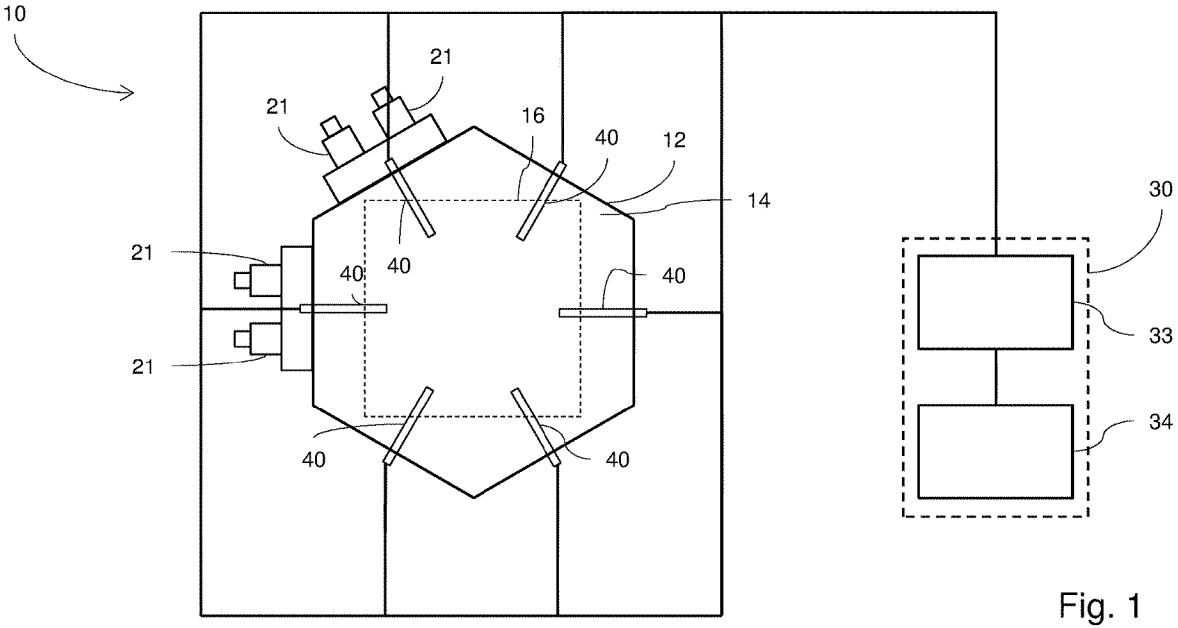
FIG. 1 shows a schematic plan view of an ultrasonic cleaning apparatus according to an example embodiment.

Referring now to FIGS. 1 and 2 there is shown a schematic overview of an ultrasonic cleaning apparatus 10 in accordance with an example embodiment. The ultrasonic cleaning apparatus 10 comprises a tank 12 which in use receives a cleaning liquid 14 and an item to be cleaned. The tank 12 comprises a cleaning region 16 to receive the item to be cleaned, for example a surgical instrument. The cleaning region 16 is suitably dimensioned to receive mesh racks loaded with surgical instruments for cleaning.

The ultrasonic cleaning apparatus of FIGS. 1 and 2 further includes a plurality of transducers 21 arranged, when driven, to direct ultrasonic pressure waves into the tank 12. In the example embodiments of FIGS. 1 and 2 transducers 21 are illustrated on some of the side wall portions of the tank 12, but it is to be understood that this is for illustration only, and other example embodiments may be provided with a symmetrical arrangement of transducers around the cleaning region 16, such as with transducers 21 provided on each of the side walls of the tank 12. The transducers 21 are operatively coupled to a controller 30, which is supplied with power and is arranged in use to drive the transducers 21 so that they emit ultrasonic pressure waves into the tank 12.

The transducers 21 are arranged in use to direct ultrasonic pressure waves into an overlapping volume in the tank 12, in the cleaning region. In this way the spread of ultrasonic pressure waves in the tank 12 can be given an effective distribution.

FIG. 1 shows an example of how the transducers from the first and second pluralities of transducers 21 are coupled to frequency generators in a controller 30. Referring to FIG. 1, the plurality of transducers is arranged with the transducers grouped into first and second groups, and the controller 30 is arranged to drive transducers of the first group at a first frequency and to drive transducers of the second group at a second frequency, the second frequency being different from the first.

The controller 30 uses a signal generator 31 to produce a drive signal for the transducers 21 that is characterised by a centre frequency, a sweep range about the centre frequency and a sweep rate. In the example embodiment shown, each generator is a 500 W generator. The controller 30 is arranged in use to control the signal generators 31 to switch between operation modes and output characteristics according to a cleaning cycle set in a programmable logic controller 32. In example embodiments, the sequential switching causes different combinations of primary and secondary operation for the first and second frequency generators to occur over time, for example in sequence.

The controller 30 further comprises a pump controller 34 and an air pump 33. The pump controller 34, air pump 33 and conduits 40 together comprise a gas introducer that provides a supply of air into the cleaning liquid 14 in the tank 12 so that macroscopic bubbles of gas are produced. The conduits 40 are arranged to provide a plurality of bubble sources distributed below the cleaning region 16 of the tank 12. In other embodiments a compressed air container may be used in place of the pump and controller, with appropriate modifications to selectively release and interrupt the supply of gas as required. Although the bubble produced are described as macroscopic, in order to distinguish from the microscopic cavitations provided by the application of ultrasound, the size of the bubble may be controlled to enable better contact with the cleaning liquid, for example by the use of thimble-like porous diffusers (not shown) provided at the end of some or all of the conduits.

Figure 2A:
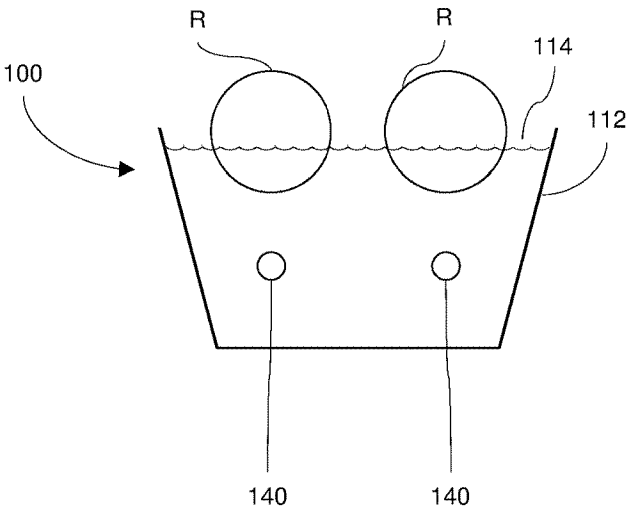
FIG. 2A shows a schematic side view of the ultrasonic cleaning apparatus of FIG. 1A.
Figure 1A:
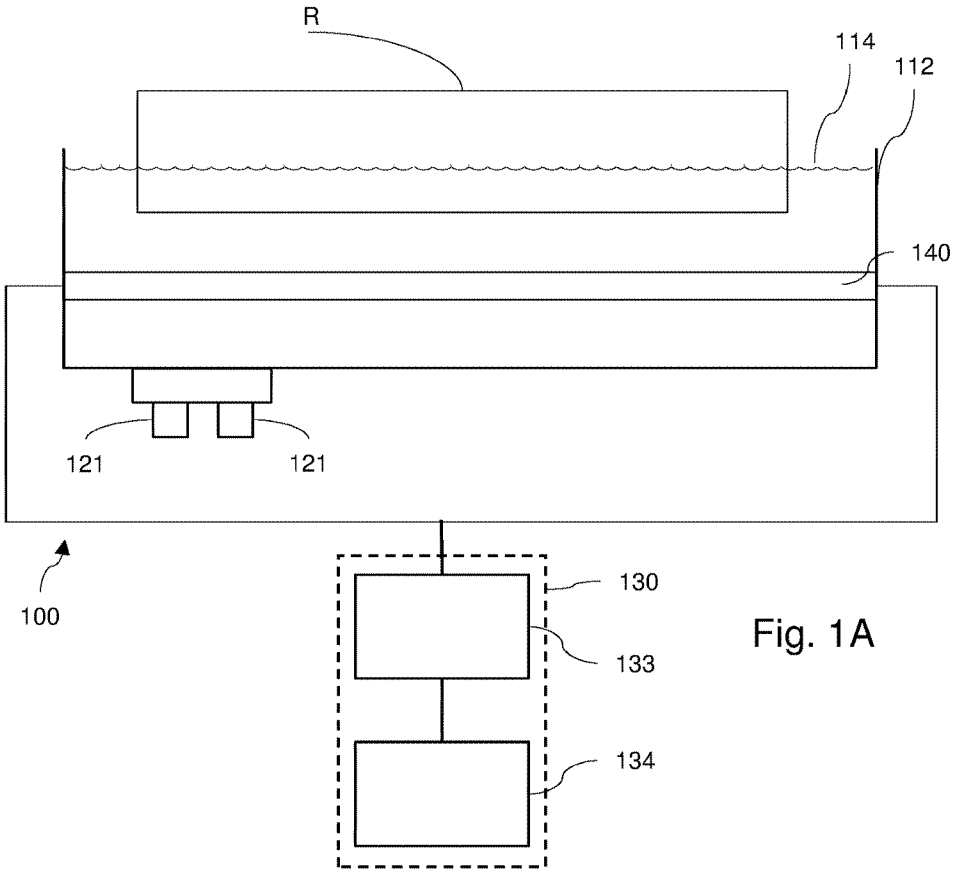
FIG. 1A shows a schematic plan view of an ultrasonic cleaning apparatus according to another example embodiment.

FIGS. 1A and 2A show another example embodiment. In FIGS. 1A and 2A reference numerals preceded by an additional number 1 are used to illustrate corresponding integers to those integers shown in FIGS. 1 and 2. In the embodiment of FIGS. 1A and 2A the tank 112 is in the form of a trough, and the items to be cleaned are print rollers R. The conduits 140 comprises perforated pipes, which when supplied with air from the air pump 133 produce macroscopic bubbles distributed along their length.

Figure 4:
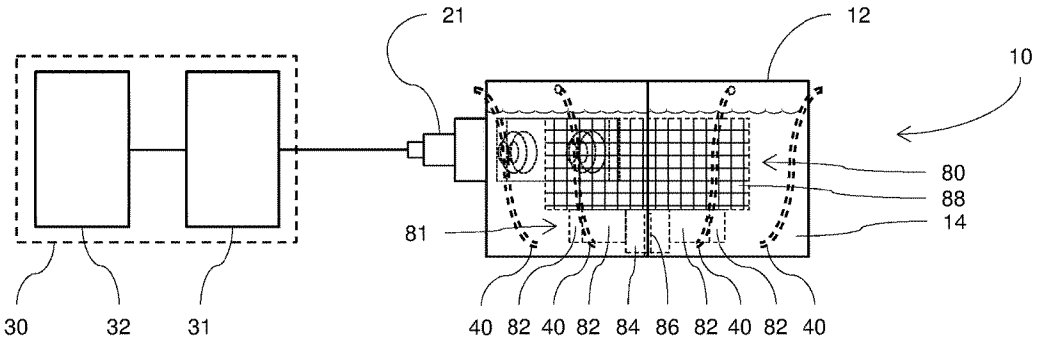
FIG. 4 shows a schematic side view of the ultrasonic cleaning apparatus of FIG. 3.
Figure 3:
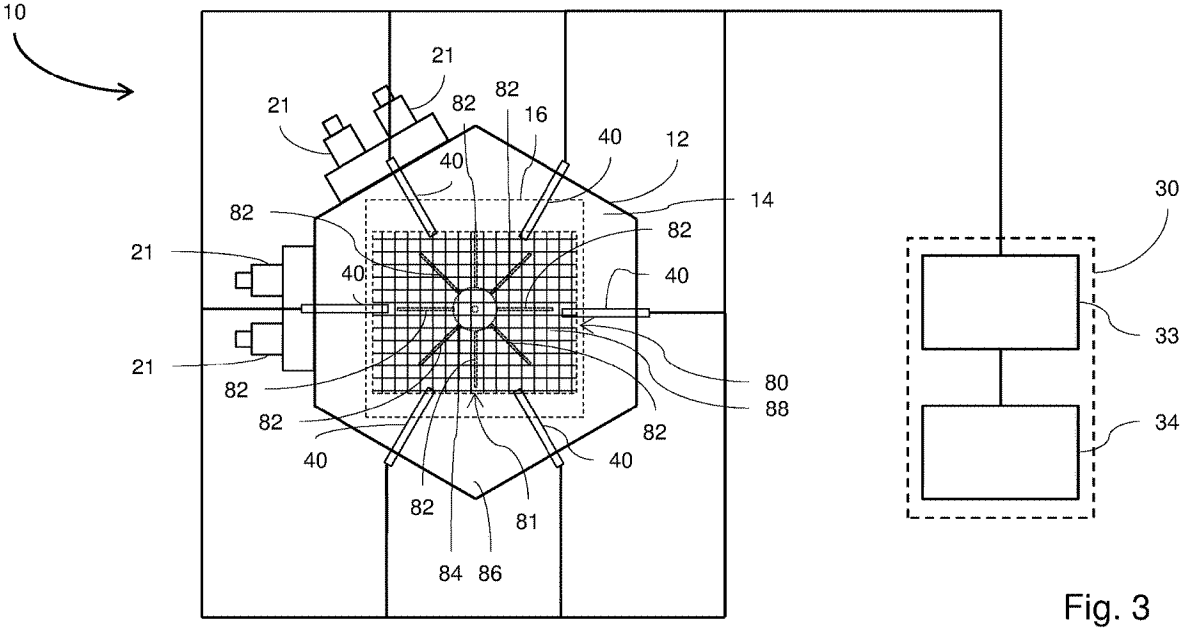
FIG. 3 shows a schematic plan view of an ultrasonic cleaning apparatus according to yet another example embodiment.

FIGS. 3 and 4 show another example embodiment. In FIGS. 3 and 4 reference numerals are used to illustrate corresponding integers to those integers shown in FIGS. 1 and 2. It will be appreciated that the various changes and modifications, illustrated and described, of FIGS. 3 and 4 when compared with FIGS. 1 and 2, may also be made to the example embodiment of FIGS. 1 and 2, without departing from the scope of the invention, as disclosed in this document.

The ultrasonic cleaning apparatus 10 further comprises an assembly 80, arranged in the cleaning region 16, to receive surgical instruments for cleaning. In the example embodiment shown the assembly 80 comprises a mesh rack 88 suitably dimensioned to receive surgical instruments for cleaning, and in other example embodiments may comprise a stack of racks 88, each rack suitably dimensioned to receive surgical instruments for cleaning. The assembly 80 comprises a rotor 81 that includes a plurality of blades 82 arranged about a drum 84. The assembly 80 still further comprises a shaft 86 arranged on, and projecting upwardly from the bottom wall of the tank 12. The shaft 86 may be mechanically fixed, welded, adhered or magnetically attached or otherwise secured to the bottom wall of the tank 12. The drum 84 is arranged to rotate about a vertical axis defined by the shaft 86. The shaft 86 may present a generally horizontal bearing surface, or mounting surface for a bearing at an upper end thereof, and may also provide a central feature, for example a pin or recess to centre the rotor 81 thereon and to enable, the rotor to turn freely thereon. The contact between the shaft 86 and the rotor 81 may be provided by a rolling contact bearing at their interface for example, in such a way that the rotor 81 rests on the bearing to move. In example embodiments a bearing between the shaft 86 and rotor 81 is provided in an arrangement so that the rotor 81, and optionally also the bearing to may be readily removed from the shaft 86, and from the tank 12 for example to enable periodic maintenance or replacement, or in the case of the assembly 80 to enable items to be loaded onto the rack 88 or removed therefrom outside of the tank 12.

A conduit 40 is arranged to further in use deliver bubbles towards one or more of the blades 82. These bubbles in use impinge on the blades 82 and tend to rotate the assembly 80 about the axis of the shaft 86. A plurality of conduits 40 may be arranged to each in use deliver bubbles towards one or more blades 82. The induced rotation of the assembly 80 may be continuous or intermittent and may be controllable by the controller 30 supplying signals to start and stop the supply of bubbles through the conduits 40. In this embodiment the conduit 40 comprises part of the gas introducer described above.

The assembly 80 is intended to minimise locations in the tank that, retain, entrain or otherwise retain dirt that may reduce the effectiveness of the clean from one cleaning operation in the tank to the next. Further, the arrangement of the assembly 80 in the cleaning region 16 means that the assembly 80 is itself in use cleaned. For example, in cleaning surgical instruments before sterilisation, there may be various types of biological material on the instruments, in different sized clumps, that are removed by cleaning from the surface which is being cleaned but this biological material may be transferred to and retained in the tank by a rack, mount, support or holder for the surgical instruments. The arrangement of the assembly 80 minimizes the transfer and retention of the biological material and thus dirt is effectively removed from surfaces in the tank so as to guarantee that the cleaning process can be performed effectively.

In the embodiments of FIGS. 3 and 4, blades 82 are illustrated on the underside of the assembly 80, but it is to be understood that this is by way of example only, and other example embodiments may be provided, such as with a blade provided on a side of the assembly 80 or above the assembly 80 or on one or more of the underside, a side and above the assembly 80. In the example embodiments of FIGS. 3 and 4, the gas introducer is arranged such that bubbles delivered therefrom exit in a generally horizontal initial direction, to send bubbles in a lateral direction, sideways towards the blades 82, but it is to be understood that this is for illustration only. In other example embodiments the gas introducer may be provided, such as with a gas introducer provided in the tank 12 and arranged to in use deliver bubbles below one or more blades 82 that are angled with reference to rising of bubbles in the tank, in order to thereby urge the assembly 80 to rotate by reaction force as the bubbles rise.

By providing movement as described a more effective clean can be obtained, since the items to be cleaned pass through different areas in the tank and thereby do not remain in any one spot in the cleaning region where relatively weak ultrasonic activity is provided. As set out above, ultrasonic cleaning apparatus according to example embodiments are arranged to provide movement of the items to be cleaned in use, thereby increasing effectiveness of the clean across the whole surface of the item to be cleaned. Providing movement of the items to be cleaned in use also reduces surface erosion or other damage across the whole surface of the item to be cleaned.

Figure 6:
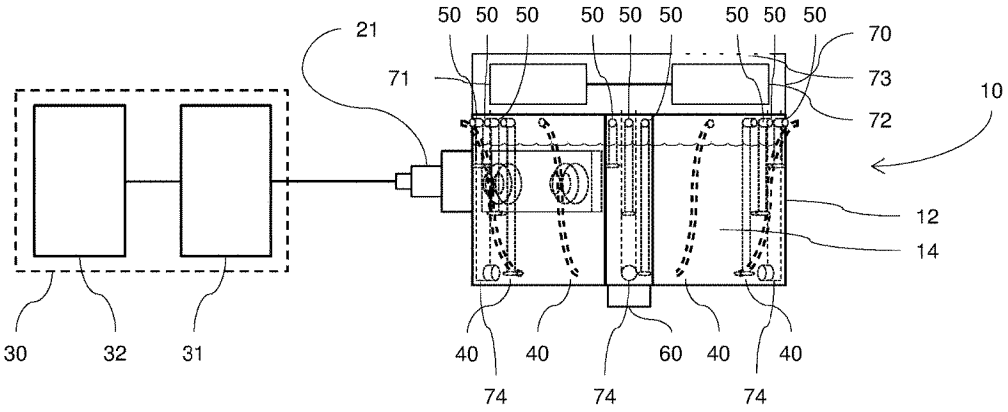
FIG. 6 shows a schematic side view of the ultrasonic cleaning apparatus of FIG. 5.
Figure 5:
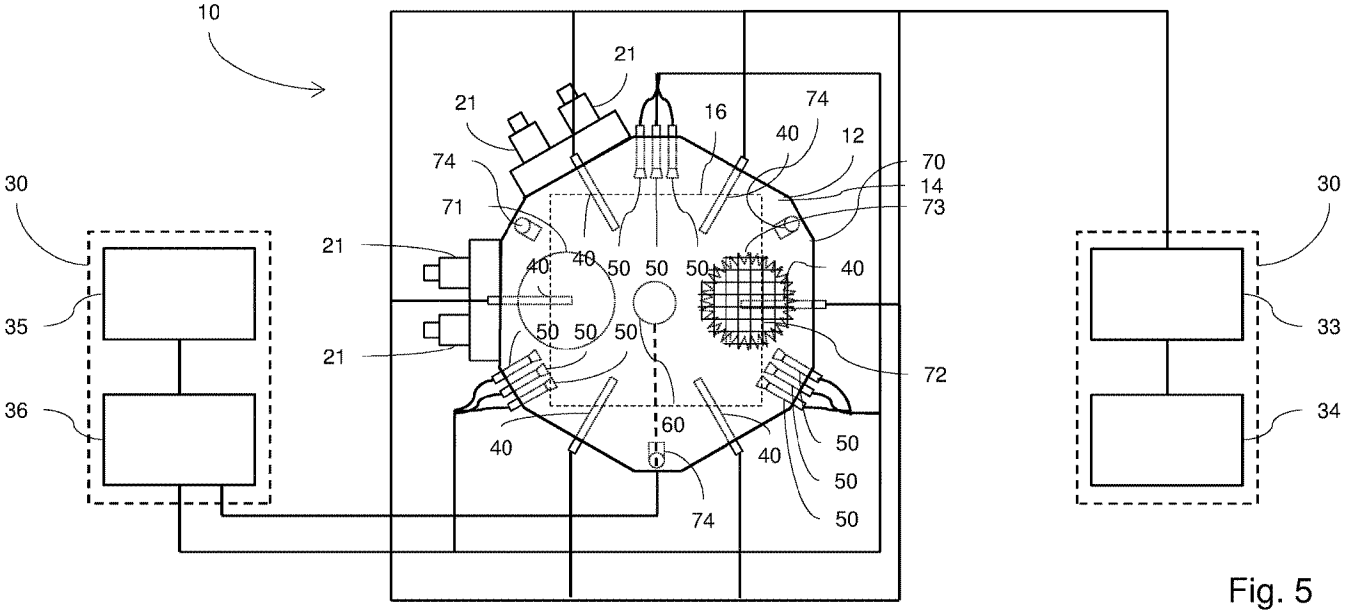
FIG. 5 shows a schematic plan view of an ultrasonic cleaning apparatus according to yet another example embodiment.

FIGS. 5 and 6 show yet another example embodiment. In FIGS. 5 and 6 reference numerals are used to illustrate corresponding integers to those integers shown in FIGS. 1 and 2. It will be appreciated that the various changes and modifications, illustrated and described, of FIGS. 5 and 6 when compared with FIGS. 1 and 2, may also be made to the example embodiment of FIGS. 3 and 4, without departing from the present disclosure. It will be appreciated that the various changes and modifications, illustrated and described, of FIGS. 3 and 4 when compared with FIGS. 1A and 2A, may also be made to the example embodiment of FIGS. 1A and 2A, without departing from the scope of the invention, as disclosed in this document.

The controller 30 further comprises a liquid pump controller 35 and a liquid pump 36. The liquid pump controller 35, liquid pump 36 and conduits 50 together comprise a liquid introducer that provides a supply of liquid into the cleaning liquid 14 in the tank 12 so that jets of liquid are produced. The liquid conduits 50 are arranged to provide a plurality of liquid jet sources arranged at a plurality of depths to in use deliver liquid towards the cleaning region 16 of the tank 12 and towards the macroscopic bubbles of gas. The outlet of drain 60 is connectable to the liquid introducer such that the cleaning liquid 14 is circulated by the liquid introducer.

In yet another example embodiment (not shown), the example embodiment of FIGS. 5 and 6 comprises a liquid introducer in which the liquid introducer serves as a fluid introducer to supply both cleaning fluid and gas. The controller further comprises a fluid pump, controller and a fluid pump. The fluid pump controller, fluid pump and conduits together comprise a fluid introducer that provides a supply of fluid into the cleaning liquid 14 in the tank 12 so that jets of fluid are produced which are a mixture of cleaning liquid and bubbles of gas. The gas in this example embodiment comprises air. The fluid conduits are arranged to provide a plurality of fluid jet sources arranged at a plurality of depths to in use deliver fluid towards the cleaning region 16 of the tank 12 and towards the macroscopic bubbles of gas as they rise through the cleaning region and to further agitate the cleaning fluid in the cleaning region. The outlet of drain 60 is connectable to the fluid introducer such that the cleaning liquid 14 is circulated by the fluid introducer.

As set out above, ultrasonic cleaners according to example embodiments can provide physical agitation of the cleaning liquid to aid dirt removal, and the introduction of gas bubbles increases the amount of gas dissolved in the cleaning liquid, thereby increasing the effect of the ultrasonic cavitation. Use of one gas introducer to cause the movement/agitation and increase the amount of dissolved gas offers a way to improve cleaning without unnecessary complication. Providing the bubbles below the cleaning region, their effect is maximised in the region of interest as they rise up and pass over and around items to be cleaned. Providing the liquid jets further increases the physical agitation of the cleaning liquid to aid dirt removal. Providing the liquid jets to disrupt the bubbles further increases the effect of ultrasonic cavitation. By use of suitable cleaning liquids it is possible to give a good cleaning effect on items contaminated with different types of biological dirt and also on delicate items, for example items of medical or surgical equipment or print rollers, without causing significant surface erosion or other damage.

It will be appreciated that the various changes and modifications, illustrated and described, of FIGS. 3 and 4 when compared with FIGS. 5 and 6, may also be made to the example embodiment of FIGS. 5 and 6, without departing from the present disclosure. In particular, a liquid conduit 50 may be arranged to further in use deliver liquid towards or below one or more blades 82, which are arranged in use to thereby rotate the assembly 80 about the vertical axis of the shaft 86.

The ultrasonic cleaning apparatus 10 further comprises a removeable tank lid 70, that comprises a fan controller 71, a fan 72, drying gas inlet 73 and drying gas outlets 74. The fan controller 71, a fan 72, drying gas inlet 73 and drying gas outlets 74 together comprise a drying gas introducer that provides a supply of drying air into the tank 12 as a means of drying. The conduits 74 are arranged to provide a plurality of drying gas sources distributed below the cleaning region 16 of the tank 12.

Figure 7:
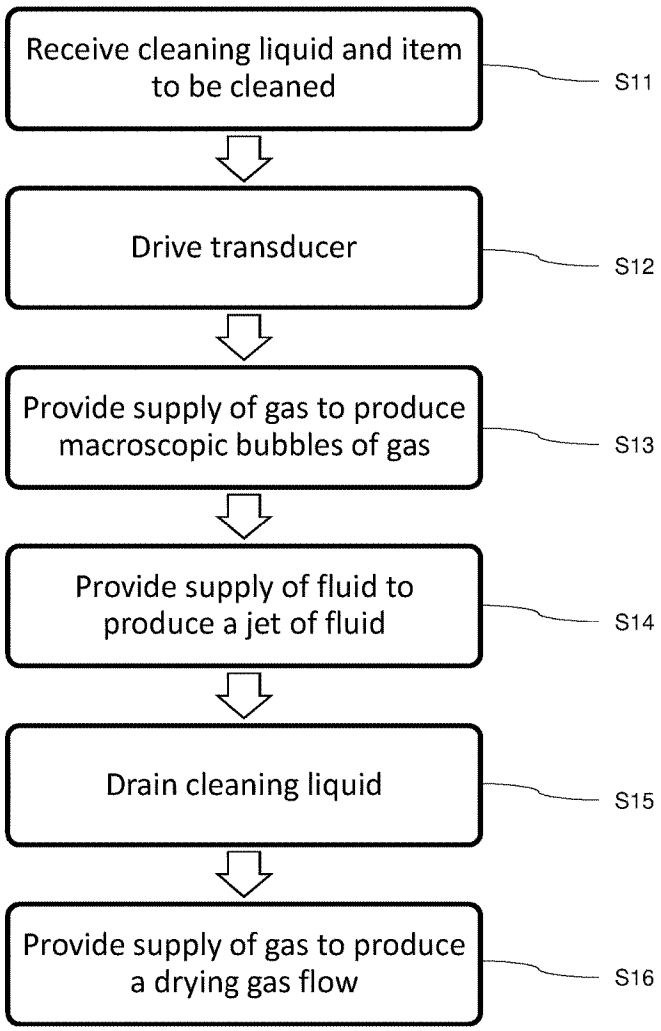
FIG. 7 shows a method of operating ultrasonic cleaning apparatus according to an example embodiment.

FIG. 7 shows a method of operating ultrasonic cleaning apparatus according to an example embodiment. At S11, cleaning liquid is received in the tank and an item to be cleaned is received in the cleaning region of the tank. At S12, the transducers are driven to direct ultrasonic pressure waves into the cleaning liquid received in the tank. At S13, a supply of gas is provided into the cleaning liquid received in the tank so that macroscopic bubbles are produced such that a plurality of bubble sources are distributed below the cleaning region of the tank. At S14, a supply of fluid is provided into the cleaning liquid received in the tank so that a jet of fluid is produced to agitate the cleaning liquid and the bubbles produced in the cleaning liquid received in the tank, although in certain example embodiments this step may be optionally omitted. The fluid comprises a mixture of cleaning liquid and air. At S15, the tank is drained of cleaning liquid. At S16, a supply of gas is provided in the tank to produce a drying gas flow, although again this step being optionally omitted in certain example embodiments, independently of the optional performance of step S14. It will be understood that in the cleaning process the order of steps relating to driving of the transducers, supply of gas for bubble formation and the provision of jets of cleaning liquid can be varied, for example to commence simultaneously, or in other sequential order as appropriate.

Figure 8:
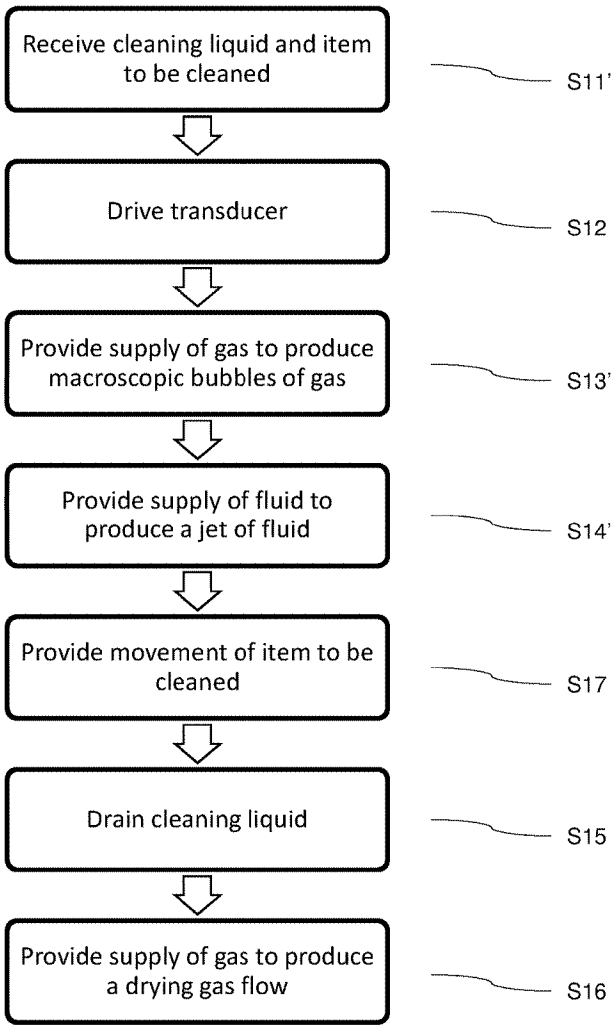
FIG. 8 shows a method of operating ultrasonic cleaning apparatus according to another example embodiment.

FIG. 8 shows a method of operating ultrasonic cleaning apparatus according to another example embodiment. In FIG. 8, like reference numerals are used to illustrate corresponding steps to those steps shown in FIG. 7. At S11', cleaning liquid is received in the tank and an item to be cleaned is received in an assembly in the cleaning region of the tank. At S12, the transducers are driven to direct ultrasonic pressure waves into the cleaning liquid received in the tank. At S13', a supply of gas is provided into the cleaning liquid received in the tank so that macroscopic bubbles are produced such that a plurality of bubble sources are distributed below the cleaning region of the tank and such that the assembly tends to move. At S14', a supply of fluid is provided into the cleaning liquid received in the tank so that a jet of fluid is produced to agitate the cleaning liquid and the bubbles produced in the cleaning liquid received in the tank and so that the assembly tends to move, although in certain example embodiments this step may be optionally omitted. The fluid comprises a mixture of cleaning liquid and air. At S17, movement of the item to be cleaned is provided by the movement of the assembly. At S15, the tank is drained of cleaning liquid. At S16, a supply of gas is provided in the tank to produce a drying gas flow, although again this step being optionally omitted in certain example embodiments, independently of the optional performance of step S14'. It will be understood that in the cleaning process the order of steps relating to driving of the transducers, supply of gas for bubble formation and the provision of jets of cleaning liquid can be varied, for example to commence simultaneously, or in other sequential order as appropriate.

As set out above, ultrasonic cleaners according to example embodiments can provide in situ drying, thereby reducing the risk of contamination and/or damage after cleaning.

Although a few preferred embodiments have been shown and described, it will be appreciated by those skilled in the art that various changes and modifications might be made without departing from the scope of the invention, and as may also be defined in any appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An ultrasonic cleaning apparatus comprising:

a tank for in use receiving a cleaning liquid and for receiving an item to be cleaned in a cleaning region thereof;

a transducer arranged, when driven, to direct ultrasonic pressure waves into cleaning liquid received in the tank;

a controller arranged in use to drive the transducer; and a gas introducer comprising a plurality of spaced apart conduits arranged around an inner diameter of the tank and extending inwardly therein, the plurality of spaced apart conduits configured to supply convergent gas streams into cleaning liquid in the tank so that macroscopic bubbles of gas are produced in the tank;

wherein the ultrasonic cleaning apparatus comprises an assembly arranged to in use enable movement of the item to be cleaned in the cleaning region, wherein the apparatus comprises a liquid conduit arranged to in use deliver liquid towards the assembly to urge the assembly to move to further facilitate cleaning of the item.

2. The ultrasonic cleaning apparatus according to claim 1, wherein the ultrasonic cleaning apparatus comprises a liquid introducer arranged to in use provide a supply of fluid into the cleaning liquid in the tank so that a jet of fluid is produced.

3. The ultrasonic cleaning apparatus according to claim 2, wherein the liquid introducer comprises a jet-forming outlet at an end region thereof, wherein the jet-forming outlet is arranged to in use deliver fluid towards a region at or above the gas introducer.

4. The ultrasonic cleaning apparatus according to claim 1, wherein the ultrasonic cleaning apparatus comprises a drying gas introducer arranged to in use provide a supply of gas into the tank so that drying gas flow is produced.

5. The ultrasonic cleaning apparatus according to claim 4, wherein the drying gas introducer further comprises a tank lid comprising a fan.

6. The ultrasonic cleaning apparatus according to claim 1, wherein the gas introducer comprises a plurality of perforated pipes arranged around the inner diameter of the tank, each perforated pipe having a gas introduction conduit and a bubble forming outlet positioned at an end region of the gas introduction conduit.

7. The ultrasonic cleaning apparatus according to claim 6, wherein the gas introduction conduit is arranged to in use deliver gas across the cleaning region.

8. The ultrasonic cleaning apparatus according to claim 1, wherein the assembly is provided for actuation from within the tank.

9. The ultrasonic cleaning apparatus according to claim 1, wherein the assembly is arranged in use to be rotatable about a vertical axis.

10. A method of operating an ultrasonic cleaning apparatus, the ultrasonic cleaning apparatus comprising:

a tank for receiving a cleaning liquid and for receiving an item to be cleaned in a cleaning region thereof;

a transducer arranged, when driven, to direct ultrasonic pressure waves into cleaning liquid received in the tank;

a controller arranged to drive the transducer; and a gas introducer comprising a plurality of spaced apart conduits arranged around an inner diameter of the tank and extending inwardly therein, the plurality of spaced apart conduits configured to supply convergent gas streams into cleaning liquid in the tank so that macroscopic bubbles of gas are produced in the tank;

the method comprising:

receiving cleaning liquid and the item to be cleaned in the cleaning region of the tank;

driving the transducer to direct ultrasonic pressure waves into the cleaning liquid in the tank; and providing a supply of gas into cleaning liquid in the tank so that macroscopic bubbles of gas are produced from the plurality of spaced apart conduits arranged around the inner diameter in the tank, wherein the ultrasonic cleaning apparatus comprises an assembly arranged to in use enable movement of the item to be cleaned in the cleaning region, the method comprising providing movement of the item to be cleaned, wherein the apparatus comprises a liquid conduit arranged to in use deliver liquid towards the assembly to urge the assembly to move to further facilitate cleaning of the item.

11. The method of operating the ultrasonic cleaning apparatus according to claim 10, wherein the ultrasonic cleaning apparatus comprises a liquid introducer arranged to provide a supply of fluid into the cleaning liquid in the tank so that a jet of fluid is produced, and the method further comprising providing the jet of fluid from the liquid introducer.

12. The method of operating the ultrasonic cleaning apparatus according to claim 10, wherein the ultrasonic cleaning apparatus comprises a drying gas introducer arranged to provide a supply of gas into the tank so that drying gas flow is produced, and the method further comprising draining the tank and providing a supply of gas into the tank so that the drying gas flow is produced.

* * * * *